US009200352B2

(12) United States Patent
Saito et al.

(10) Patent No.: US 9,200,352 B2
(45) Date of Patent: Dec. 1, 2015

(54) HIGH STRENGTH GALVANNEALED STEEL SHEET WITH EXCELLENT APPEARANCE AND METHOD FOR MANUFACTURING THE SAME

(75) Inventors: Hayato Saito, Tokyo (JP); Hiromi Yoshida, Tokyo (JP); Takeshi Yokota, Tokyo (JP); Yasushi Tanaka, Tokyo (JP)

(73) Assignee: JFE Steel Corporation (JP)

( * ) Notice: Subject to any disclaimer, the term of this patent is extended or adjusted under 35 U.S.C. 154(b) by 656 days.

(21) Appl. No.: 13/057,331

(22) PCT Filed: Jul. 28, 2009

(86) PCT No.: PCT/JP2009/063715

§ 371 (c)(1),
(2), (4) Date: Feb. 3, 2011

(87) PCT Pub. No.: WO2010/016447

PCT Pub. Date: Feb. 11, 2010

(65) Prior Publication Data

US 2011/0139316 A1 Jun. 16, 2011

(30) Foreign Application Priority Data

Aug. 5, 2008 (JP) ..... 2008-201736

(51) Int. Cl.

| | |
|---|---|
| ***B32B 15/01*** | (2006.01) |
| ***B32B 15/00*** | (2006.01) |
| ***C23C 2/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/16*** | (2006.01) |
| ***C22C 38/60*** | (2006.01) |
| ***C21D 8/04*** | (2006.01) |
| ***C22C 38/14*** | (2006.01) |
| ***C23C 2/02*** | (2006.01) |
| ***C23C 2/06*** | (2006.01) |
| ***C23C 2/28*** | (2006.01) |

(52) U.S. Cl.

CPC ..... *C22C 38/02* (2013.01); *C21D 8/0405* (2013.01); *C22C 38/001* (2013.01); *C22C 38/04* (2013.01); *C22C 38/06* (2013.01); *C22C 38/08* (2013.01); *C22C 38/14* (2013.01); *C22C 38/16* (2013.01); *C23C 2/02* (2013.01); *C23C 2/06* (2013.01); *C23C 2/28* (2013.01); *C21D 2211/005* (2013.01)

(58) Field of Classification Search

None

See application file for complete search history.

(56) References Cited

U.S. PATENT DOCUMENTS

| | | | | |
|---|---|---|---|---|
| 5,853,659 | A * | 12/1998 | Sekita et al. | 420/92 |
| 2003/0196735 | A1 * | 10/2003 | Sugiura et al. | 148/602 |
| 2006/0169365 | A1 * | 8/2006 | Ono et al. | 148/320 |

FOREIGN PATENT DOCUMENTS

| | | | | |
|---|---|---|---|---|
| EP | 0 632 141 | A1 | 1/1995 | |
| JP | 48-048318 | A | 7/1973 | |
| JP | 48-48318 | A | 7/1973 | |
| JP | 3 150315 | A | 6/1991 | |
| JP | 6 100980 | A | 4/1994 | |
| JP | 6 212276 | A | 8/1994 | |
| JP | 6-269840 | A | 9/1994 | |
| JP | 9-184045 | A | 7/1997 | |
| JP | 10-183253 | A | 7/1998 | |
| JP | 2828815 | * | 11/1998 | C21D 8/02 |
| JP | 2001-342541 | A | 12/2001 | |
| JP | EP 1291448 | * | 3/2003 | C22C 38/00 |
| JP | 2007-169739 | A | 7/2007 | |
| JP | 4044795 | B2 | 2/2008 | |
| JP | 2008-169427 | * | 7/2008 | C22C 38/00 |

OTHER PUBLICATIONS

Allen, Press Forming of Coated Steel, 14B,ASM Handbook 547-553 (2006).*

English translation of JP 2008-169427.*

Jordan et al, Automotive Body Corrosion, 13C ASM Handbook 515-518 (2006).*

English translation of JP2828815 (1998).*

* cited by examiner

*Primary Examiner* — Yoshitoshi Takeuchi

(74) *Attorney, Agent, or Firm* — DLA Piper LLP (US)

(57) ABSTRACT

A high strength galvanized steel sheet with excellent appearance that does not have non-uniformity of coating or coating defects or allow linear defects to occur after press forming includes a steel sheet having a ferrite single-phase structure and having a composition containing 0.0005% to 0.0040% by mass of C; 0.1% to 1.0% by mass of Si; 1.0% to 2.5% by mass of Mn; 0.01% to 0.20% by mass of P; 0.015% by mass of less of S; 0.01% to 0.10% by mass of Al; 0.0005% to 0.0070% by mass of N; 0.010% to 0.080% by mass of Ti; 0.0005% to 0.0020% by mass of B; 0.05% to 0.50% by mass of Cu; 0.03% to 0.50% by mass of Ni; and the balance of Fe and incidental impurities.

6 Claims, No Drawings

HIGH STRENGTH GALVANNEALED STEEL SHEET WITH EXCELLENT APPEARANCE AND METHOD FOR MANUFACTURING THE SAME

RELATED APPLICATIONS

This is a §371 of International Application No. PCT/JP2009/063715, with an inter-national filing date of Jul. 28, 2009 (WO 2010/016447 A1, published Feb. 11, 2010), which is based on Japanese Patent Application No. 2008-201736, filed Aug. 5, 2008, the subject matter of which is incorporated by reference.

TECHNICAL FIELD

This disclosure relates to a high strength galvanized steel sheet with excellent appearance suitable for automotive inner and outer panels and to a method for manufacturing the same.

BACKGROUND

The emission control of $CO_2$ has recently become strict. Accordingly, it is increasingly desired that fuel efficiency of vehicles be increased by reducing vehicle weight, and reducing the thicknesses of automotive parts by using high strength steel sheets. As the high strength galvanized steel sheet is broadly applied, the requirements of formability and surface quality become strict. Accordingly, a high strength galvanized steel sheet prepared by adding a solute-strengthening element to a so-called "IF" steel in which C and N are precipitated and fixed is often used, in view of the formability and the corrosion resistance (Japanese Unexamined Patent Application Publication No. 2007-169739). The surface quality of the galvanized steel sheet may be degraded due to non-uniformity of coating and a coating defect resulting from Fe—Si oxides or Si oxides such as $SiO_2$, precipitated at the surface of the base iron. Also, scale produced during hot rolling may be partially left after pickling and cold rolling and result in non-uniformity of coating. It is known that such a surface defect produced by scale can degrade surface quality. Also, if non-uniform nitridation occurs during annealing, non-uniform deformation may be caused by press forming. Consequently, linear defects may be produced in the surface of the resulting product.

To solve these problems, a semi-ultra-low carbon steel sheet exhibiting high surface quality and superior press formability and a method for manufacturing the same are disclosed (Japanese Patent No. 4044795). Also, a method for manufacturing a hot rolled steel sheet exhibiting high surface quality is disclosed for descaling in a process of hot rolling (Japanese Unexamined Patent Application Publication No. 6-269840).

Furthermore, a method for preventing nitrogen from permeating the steel sheet during annealing is disclosed for preventing nitridation during annealing (Japanese Unexamined Patent Application Publication No. 48-48318).

The technique disclosed in JP '739 is not effective in enhancing the quality of appearance of coated steel sheets.

In the technique disclosed in JP '795, a relatively large amount of C is used. Accordingly, it is required that a large amount of Nb and Ti, which are elements producing carbonitrides, be added to fix C and N in a form of their alloy precipitate. Consequently, nitridation is likely to occur during annealing and result in linear defects after press forming. JP '795 does not also lead to a new finding about surface defects caused by scale.

JP '840 requires reheating at the inlet side of the finishing mill and, accordingly, energy cost is increased. In addition, if scale is trapped during roughing rolling and, thus, a cause of defects exists, the effect of reheating is limited.

JP '318 is intended to prevent low-carbon steel from being nitrided during batch annealing, and does not lead to a finding about the behavior of nitridation of ultra-low carbon and high strength steel sheets during continuous annealing.

IF steel-based high strength galvanized steel sheets thus cannot completely prevent Si oxide from causing non-uniformity of coating or a coating defect, or scale from causing non-uniformity of coating, or cannot prevent nitridation during annealing to produce linear defects after press forming. Thus, satisfying appearance quality cannot be achieved.

It could therefore be helpful to provide a high strength galvanized steel sheet with excellent appearance and a method for manufacturing the same that does not have non-uniformity of coating or a coating defect caused by Si oxide or non-uniformity of coating caused by scale, and does not allow linear defects to be caused after press forming by nitridation occurring during annealing.

SUMMARY

We studied the composition of the steel and its manufacturing conditions, and discovered the following findings:

The non-uniformity of coating caused by Si oxide can be prevented by adding Cu and Ni in the steel to prevent concentration of Si and formation of Si oxide at the surface of the base iron, and by intensively performing descaling to remove the undesirably produced Si oxide in roughing rolling and finish rolling.

The non-uniformity of coating caused by scale can be prevented by intensively performing descaling in roughing rolling and finish rolling and, in addition, by controlling the hydrogen concentration in the annealing furnace.

Although a high concentration of hydrogen in the annealing furnace facilitates nitridation, the surface of the steel can be prevented from being nitrided by simultaneously adding Cu and Ni to the steel, even if the hydrogen concentration is high. The linear defects caused after press forming by nitridation during annealing can thus be reduced. In addition, by intensively performing descaling in the hot rolling step, the surface state of the steel is made uniform and, if nitridation occurs, uniform nitridation occurs. Consequently, the linear defects can further be reduced.

We thus provide the following:

[1] A high strength galvanized steel sheet with excellent appearance is provided which has a steel composition containing 0.0005% to 0.0040% by mass of C, 0.1% to 1.0% by mass of Si; 1.0% to 2.5% by mass of Mn; 0.01% to 0.20% by mass of P; 0.015% by mass or less of S; 0.01% to 0.10% by mass of Al; 0.0005% to 0.0070% by mass of N; 0.010% to 0.080% by mass of Ti; 0.0005% to 0.0020% by mass of B; 0.05% to 0.50% by mass of Cu; 0.03% to 0.50% by mass of Ni; and the balance of Fe and incidental impurities, and the composition satisfies relationships (1) and (2):

$$[Ti] \geq (47.9/14) \times [N] + (47.9/12) \times [C] \quad (1)$$

$$[Ni] \geq 0.4 \times [Cu] \quad (2).$$

In the relationships, [element] represents the content (percent by mass) of the element. The steel sheet has a ferrite single-phase structure at the surface, and a galvanized coating or a galvannealed coating is formed on the surface of the steel sheet. The high strength galvanized steel sheet has a tensile strength (TS) of 440 MPa or more:

[2] The composition of the high strength galvanized steel sheet of [1] further contains at least one of 0.0030% to 0.0150% by mass of Sb and 0.0020% to 0.0150% by mass of Sn.

[3] The composition of the high strength galvanized steel sheet of [1] or [2] further contains at least one of 0.01% to 0.08% by mass of Nb, 0.01% to 0.08% by mass of V and 0.01% to 0.10% by mass of Mo. If the composition contains V, Relationship (3) holds:

$$[Ti]+[Nb]+[V]\leq 0.08 \quad (3).$$

In the relationship, [element] represents the content (percent by mass) of the element.

[4] A method for manufacturing a high strength galvanized steel sheet with excellent appearance is provided. The method includes: the hot rolling step of heating a steel slab having the composition of [1], [2] or [3] to a temperature of 1100° C. or more, performing roughing rolling on the heated steel slab three passes or more, performing finish rolling after performing descaling at a collision pressure of 1.0 MPa or more, and coiling the rolled steel at a temperature in the range of 550 to 680° C., wherein at least three passes of the roughing rolling are each performed after descaling, and the finish rolling is terminated between the $Ar_3$ temperature and 950° C.; the cold rolling step of performing cold rolling on the hot-rolled steel at a rolling reduction in the range of 50% to 80% after pickling; the annealing step of soaking the rolled steel in a reducing atmosphere containing 7.0% by volume or more of hydrogen at a temperature in the range of 700 to 850° C. for 30s or more; and the step of forming a galvanized coating. The resulting high strength galvanized steel sheet has a ferrite single-phase structure and a tensile strength (TS) of 440 MPa or more.

[5] A method for manufacturing a high strength galvannealed steel sheet with excellent appearance is provided. The method includes: the hot rolling step of heating a steel slab having the composition of [1], [2] or [3] to a temperature of 1100° C. or more, performing roughing rolling on the steel slab three passes or more, performing finish rolling after performing descaling at a collision pressure of 1.0 MPa or more, and coiling the rolled steel at a temperature in the range of 550 to 680° C., wherein at least three passes of the roughing rolling are each performed after descaling, and the finish rolling is terminated between the $Ar_3$ temperature and 950° C.; the cold rolling step of performing cold rolling on the hot-rolled steel at a rolling reduction in the range of 50% to 80% after pickling; the annealing step of soaking the cold-rolled steel in a reducing atmosphere containing 7.0% by volume or more of hydrogen at a temperature in the range of 700 to 850° C.; and the step of forming a galvanized coating and alloying the galvanized coating. The resulting high strength galvannealed steel sheet has a ferrite single-phase structure and a tensile strength (TS) of 440 MPa or more.

The high strength galvanized steel sheet has excellent appearance without non-uniformity of coating or a coating defect, or without allowing linear defects to be caused in the surface after press forming. The high strength galvanized steel sheet is useful as a steel sheet used for automotive inner and outer panels.

DETAILED DESCRIPTION

The reason will now be described why the steel composition of the high strength galvanized steel sheet is limited. "%" used in the steel composition represents percent by mass unless otherwise specified.

C: 0.0005% to 0.0040%

A low C content is advantageous in terms of formability, and the content of an alloy such as a Ti alloy, which is added for fixing C in a form of carbide, is increased according to the C content. Accordingly, the upper limit of the C content is 0.0040%. Preferably, the C content is 0.0030% or less. The lower limit is preferably low. However, an excessively low C content leads to an increased steel making cost. Accordingly, the lower limit is 0.0005%.

Si: 0.1% to 1.0%

Si is effective as a solute strengthening element and can enhance strength comparatively without reducing formability. To ensure this effect, the lower limit of the Si content is 0.1%. If Si is excessively added, Si concentration or formation of Si oxide at the surface is considerably increased by heating the slab. Accordingly, the Si oxide cannot be removed sufficiently even by adding Cu or Ni, or descaling in the hot rolling step, and causes non-uniformity of coating or a coating defect. The upper limit is 1.0%. In view of the appearance quality, the Si content is preferably 0.7% or less.

Mn: 1.0% to 2.5%

Mn is effective as a solute strengthening element, and its lower limit is 1.0% from the viewpoint of enhancing the strength. Preferably, the Mn content is 1.5% or more. If Mn is excessively added, the formality and the resistance to cold-work brittleness are reduced. Accordingly, the upper limit is 2.5%. Preferably, the Mn content is 2.2% or less.

P: 0.01% to 0.20%

P is effective as a solute strengthening element, and also has the effect of increasing the r value. To ensure these effects, it is required that 0.01% or more of P be added. Preferably, 0.03% or more of P is added. If P is excessively added, it is considerably segregated at the grain boundary to make the grain boundary brittle, or becomes liable to segregate at the center. Accordingly, the upper limit is 0.20%. Preferably, 0.10% or less of P is added.

S: 0.015% or less

If the S content is high, a large amount of sulfides, such as MnS, is produced and local ductility represented by stretch flangeability is reduced. Accordingly, the upper limit of the S content is 0.015%. Preferably, 0.010% or less of S is added. Preferably, the S content is 0.005% or more because S has the effect of enhancing the ability of removing scale.

Al: 0.01% to 0.10%

Al is essential for deoxidation. To ensure deoxidation, it is required that 0.01% or more of Al be added. The deoxidation effect is saturated at an Al content of 0.10%, and the upper limit of the Al content is 0.10%.

N: 0.0005~0.0070%

As with C, a low N content is advantageous in terms of formability, and the content of an alloy such as a Ti alloy, which is added to fix N in the form of nitride, is increased according to the N content. Accordingly, the upper limit of the N content is 0.0070%. The lower limit is preferably low. However, an excessively low N content leads to an increased steel making cost. Accordingly, the lower limit is 0.0005%.

Ti: 0.010% to 0.080%, $[Ti]\geq(47.9/14)\times[N]+(47.9/12)\times[C]$

Ti fixes solute C and solute N as TiC and TiN, thereby enhancing formability. To ensure this effect, it is required that at least 0.010% of Ti be added. To fix C and N more sufficiently, the amount of Ti is varied according to the C and N contents, and it is desired that the following relationship (1) be satisfied:

$$[Ti]\geq(47.9/14)\times[N]+(47.9/12)\times[c] \quad (1).$$

In the relationship, [element] represents the content (mass percent) of the element.

If Ti is excessively added, the effect of fixing C and N is saturated, and nitridation becomes liable to occur during annealing and, thus, may cause linear defects after press forming. Accordingly, the upper limit is 0.080%.

Cu: 0.05% to 0.50%

Cu is an important element to obtain an excellent appearance. By simultaneously adding Cu with Ni to an ultra-low carbon high strength steel sheet, nitridation occurring during annealing can be prevented even in a high hydrogen atmosphere, and thus the occurrence of linear defects after press forming can be prevented. This is probably because Cu and Ni are concentrated at the surface to prevent the nitridation occurring during annealing effectively. In addition, Cu has the effects of preventing Si from being concentrated at the surface or Si oxide from being produced while the slab is heated, and is also effective as a solute strengthening element. To ensure these effects, it is required that at least 0.05% of Cu be added. If Cu is excessively added, not only the cost is increased, but also a small crack occurs in the surface during hot rolling, thus degrading the surface quality. Accordingly, the upper limit of the Cu content is 0.50%.

Ni: 0.03% to 0.50%, [Ni]≥0.4×[Cu]

Ni is an important element to obtain an excellent appearance. By simultaneously adding Ni with Cu to an ultra-low carbon high strength steel sheet, nitridation occurring during annealing can be prevented even in a high hydrogen atmosphere, and thus the occurrence of linear defects after press forming can be prevented. This is probably because Cu and Ni are concentrated at the surface to prevent nitridation occurring during annealing effectively. In addition, Ni has the effects of preventing Si from being concentrated at the surface or Si oxide from being produced while the slab is heated, and is also effective as a solute strengthening element. To ensure these effects, it is required that at least 0.03% of Ni be added, and that the Ni content be varied according to the Cu content to satisfy the following relationship (2):

$$[Ni] \geq 0.4 \times [Cu] \quad (2).$$

However, these effects are saturated at a Ni content of 0.50%, and excessive addition increases the const. Accordingly, the upper limit is 0.50%.

B has the effects of enhancing the resistance to cold-work brittleness, and refining the grain size of the microstructure to enhance the strength. To ensure these effects, the lower limit of the B content is 0.0005%. If more than 0.0020% of B is added, formability is seriously degraded. Accordingly, the lower limit is 0.0020%.

In addition to the above-described steel components, there may be added at least one element selected from among 0.0030% to 0.0150% of Sb, 0.0020% to 0.0150% of Sn, 0.01% to 0.08% of Nb, 0.01% to 0.08% of V, and 0.01% to 0.10% of Mo.

Sb: 0.0030% to 0.0150%

Sb is concentrated at the surface to prevent nitridation. By adding at least 0.0030% of Sb, linear defects resulting from nitridation occurring during annealing can be prevented from occurring after press forming. However, this effect is saturated at a Sb content of 0.0150%, and excessive addition increases the cost. Accordingly, the upper limit of the Sb content is 0.0150%.

Sn: 0.0020% to 0.0150%

As with Sb, Sn is concentrated at the surface to prevent nitridation. By adding at least 0.0020% of Sn, linear defects resulting from nitridation occurring during annealing can be prevented from occurring after press forming. However, this effect is saturated at a Sn content of 0.0150%, and excessive addition increases the cost. Accordingly, the upper limit of the Sb content is 0.0150%.

Nb: 0.01% to 0.08%

As with Ti, Nb has the effect of fixing solute C and solute N to enhance formability. In addition, Nb has the effect of refining the grain size to enhance strength. To ensure these effects, it is required that at least 0.01% of Nb be added. If Nb is excessively added, these effects are saturated, and nitridation becomes liable to occur during annealing and, thus, may cause linear defects after press forming. Accordingly, the upper limit is 0.08%.

V: 0.01% to 0.08%

As with Ti, V has the effect of fixing solute C and solute N to enhance formability. In addition, V has the effect of refining the grain size to enhance strength. To ensure these effects, it is required that at least 0.01% of V be added. If V is excessively added, these effects are saturated, and nitridation becomes liable to occur during annealing and, thus, may cause linear defects after press forming. Accordingly, the upper limit is 0.08%:

$$[Ti]+[Nb]+[V] \leq 0.08 \quad (3).$$

If at least one of Nb and V is added together with Ti, the total content of Ti, Nb and V are controlled to satisfy the above relationship (3) from the viewpoint of preventing nitridation occurring during annealing. This is because the presence of a nitride-forming element makes nitridation easy.

Mo: 0.01~0.10%

Mo is effective as a solute strengthening element and also has the effect of enhancing the resistance to cold-work brittleness. To ensure these effects, it is required that at least 0.01% of Mo be added. However, these effects are saturated at a Mo content of 0.10%, and excessive addition increases the const. Accordingly, the upper limit of the Mo content is 0.10%.

The microstructure and the tensile strength (TS) of the steel sheet will now be described.

The high strength galvanized steel sheet has a ferrite single-phase structure. The microstructure formed of a ferrite phase exhibits superior ductility and deep drawability.

The high strength galvanized steel sheet having the above-described composition and microstructure exhibits a tensile strength (TS) of 440 MPa or more. By using a high strength steel sheet having a TS of 440 MPa or more in parts conventionally made of known 270 MPa-grade or 340 MPa-grade steel sheets, the thickness of the material can be reduced and, accordingly, the weight of the parts can be reduced. If the tensile strength is excessively enhanced in the ferrite single-phase structure, formability is considerably reduced. Accordingly, TS is preferably 490 MPa or less. The above-described high strength galvanized steel sheet has excellent appearance after forming a galvanized coating, or after alloying the galvanized coating, without non-uniformity of coating or a coating defect caused by Si oxide, or non-uniformity of coating caused by scale. The high strength galvanized steel sheet also exhibits excellent appearance without linear defects even after press forming.

A method for manufacturing the high strength galvanized steel sheet will now be described.

In the manufacture of the high strength galvanized steel sheet, a steel slab having the above-described composition is heated and subjected to roughing rolling and finish rolling in a hot rolling step. After removing scale on the surface of the hot rolled steel sheet by pickling, a cold rolling step and an annealing step are performed. After the annealing step, a galvanized coating is formed and, if necessary, the coating is further alloyed.

The steel slab can be prepared by any process.

Hot Rolling Step

After being heated, the slab is subjected to roughing rolling and finish rolling, and the rolled steel is wound into a coil. The hot rolling conditions are limited as follows for the following reasons:

Slab heating temperature: 1100° C. or more

If the slab is heated at a temperature of less than 1100° C., the rolling load is increased to reduce productivity. Accordingly, the slab heating temperature is set to 1100° C. or more. If initial scale is increased by heating the slab at a high temperature, however, the scale is liable to remain, and the quality of the appearance after coating is degraded. Accordingly, the slab heating temperature is preferably set to 1220° C. or less.

The number of passes of roughing rolling and method for descaling

To produce the effects of removing the initial scale from the steel sheet and the secondary scale produced during rolling to prevent surface defects caused by the scale, and also to produce the effect of removing silicon oxide, roughing rolling is performed in at least three passes, and descaling is performed before each of at least three passes of roughing rolling. Preferably, the roughing rolling is performed in 5 passes or more, and descaling is performed before each pass.

Before finish rolling, descaling is performed at a collision pressure of 1.0 MPa or more. Then, finish rolling is performed. To remove Si oxide on the surface of the base iron to prevent the non-uniformity of coating, it is necessary to perform descaling at a collision pressure of 1.0 MPa or more before finish rolling. From the viewpoint of further enhancing the surface quality, the collision pressure is preferably 1.5 MPa or more.

Finish rolling final temperature: $Ar_3$ temperature to 950° C.

If the finish rolling final temperature is lower than the $Ar_3$ temperature, a rolled microstructure remains in the hot rolled steel sheet, and formability after annealing is degraded. In contrast, if the finish rolling final temperature is higher than 950° C., the microstructure of the hot rolled steel sheet becomes coarse and degrades strength after annealing. Accordingly, the finish rolling final temperature is set between the Ar3 temperature and 950° C.

Coiling temperature: 550° C. to 680° C.

If the steel composition contains Ti, Nb or V, the rolled steel is coiled at a temperature of 550° C. or more so that carbides and nitrides of these elements can be formed to fix solute C and solute N and thus enhance formability. If the coiling temperature is higher than 680° C., phosphides containing Fe or Ti are produced to reduce the strength and formability. Accordingly, the coiling temperature is set to 680° C. or less.

After the hot rolling step, pickling is performed to remove scale on the surface of the hot rolled steel sheet. Any method for acid washing can be applied. A conventional method may be employed.

Cold Rolling Step

Cold rolling reduction: 50% to 80%

After acid washing, cold rolling is performed. To refine the grain size of the steel after annealing to obtain a predetermined strength, cold rolling reduction is required to be 50% or more. If deep drawability is further required, the cold rolling reduction is preferably 60% or more. A cold rolling reduction of more than 80% increases the load and results in considerably degraded productivity. Accordingly, the upper limit is 80%.

Annealing Step

Annealing temperature: 700 to 850° C., holding time: 30 s or more

To recrystallize the cold-rolled microstructure to enhance formability, annealing is performed at a temperature of 700° C. or more, and the annealing temperature is held for 30 s or more. If the annealing is performed at a temperature of higher than 850° C., the grain size is increased and reduces strength. Accordingly, the higher limit of annealing temperature is 850° C. If the holding time at the annealing temperature is longer, the grain size is increased to reduce strength, and productivity is reduced. Accordingly, the holding time is preferably set to 300 s or less.

Hydrogen Concentration: 7.0% by Volume or More

By completely reducing the scale partially left after pickling and cold rolling to prevent the occurrence of non-uniformity of coating or a coating defect, it is necessary to control the hydrogen concentration during soaking in the annealing step to 7.0% by volume or more. From the viewpoint of preventing scale from causing a defect, preferably, the hydrogen concentration is 8.0% by volume or more. On the other hand, as the hydrogen concentration is increased, nitridation is liable to occur during annealing. Preferably, the hydrogen concentration is 15.0% by volume or less.

Coating Step

After annealing, a galvanized coating is formed over the steel sheet and, if necessary, the coating is further alloyed. Thus, the high strength galvanized steel sheet is completed. For forming the coating, preferably, the zinc bath temperature is set to 440 to 480° C., and the steel sheet to be coated is heated to a temperature between the coating bath temperature and the coating bath temperature +30° C. If the resulting coating is alloyed, preferably, the steel sheet is held at a temperature in the range of 480 to 540° C. for 1 second or more.

EXAMPLE 1

Examples will now be described. Steels having the compositions shown in Table 1 were prepared, and cast into slabs having a thickness of 230 mm. Each slab was heated at 1200° C. for 1 hour and subjected to hot rolling. In the hot rolling step, roughing rolling was performed in 7 passes and descaling was performed before each pass of the roughing rolling. Hence, descaling was performed 7 times in total. Subsequently, descaling was further performed with a scale breaker (FSB) at a collision pressure of 1.5 MPa before finish rolling. The finish rolling was terminated at 890° C. The steel sheet was thus finished to a thickness of 3.2 mm, cooled to 640° C., and coiled at that temperature. The resulting hot rolled steel sheet was pickled and subjected to cold rolling at a cold rolling reduction of 62.5% and finished to a thickness of 1.2 mm. Then, the cold rolled steel sheet was soaked at an annealing temperature of 820° C. for 90 s in an atmosphere containing 8.0% by volume of hydrogen in a CGL. Subsequently, a galvanized coating (the amount of coating: 48 g/$m^2$ for each side) was formed on the steel sheet, and the coating was alloyed. The coated steel sheet was subjected to temper rolling at an elongation ratio of 0.7% to complete the manufacture of a galvanized steel sheet.

A JIS 5 tensile strength test piece was sampled from the resulting galvanized steel sheet in the direction perpendicular to the rolling direction, and subjected to a tensile test. Also, the quality of appearance was evaluated by visual observation. According to whether or not a coating defect or non-uniformity of coating existed, the quality of appearance was determined to be good when no non-uniformity of coating nor coating defect are observed; it was determined to be poor when a coating defect or non-uniformity of coating was observed. For evaluating the appearance after press forming, in addition, a 300×700 mm rectangular test piece was cut out in the direction perpendicular to the rolling direction. The test piece was 10% stretched with a tension tester, and the surface of the test piece was ground with a grindstone. It was thus investigated whether or not linear defects were produced. The test piece having no linear defects was determined to be good in appearance after forming; and the test piece having linear defects was determined to be poor in appearance after forming. Furthermore, the section of the steel sheet taken parallel to the rolling direction was mechanically ground and etched (etching solution: Nital), and the microstructure of the steel sheet was observed through an optical microscope. The resulting steel sheets all had a ferrite single-phase structure. The results of tensile test and the evaluations of the appearances of the coating and after forming are shown in Table 2.

TABLE 1

(mass %)

| No. | C | Si | Mn | P | S | Al | N | Ti | Cu | Ni | B | Others | Remark |
|---|---|---|---|---|---|---|---|---|---|---|---|---|---|
| 1 | 0.0025 | 0.20 | 2.0 | 0.075 | 0.006 | 0.05 | 0.0015 | 0.035 | 0.10 | 0.05 | 0.0010 | | Example |
| 2 | 0.0015 | 0.50 | 2.0 | 0.050 | 0.006 | 0.05 | 0.0015 | 0.035 | 0.10 | 0.05 | 0.0010 | Sb: 0.007 | Example |
| 3 | 0.0025 | 0.20 | 2.2 | 0.075 | 0.006 | 0.05 | 0.0015 | 0.035 | 0.20 | 0.10 | 0.0020 | Sb: 0.005, Sn: 0.003 | Example |
| 4 | 0.0030 | 0.20 | 2.2 | 0.050 | 0.006 | 0.05 | 0.0015 | 0.035 | 0.10 | 0.10 | 0.0007 | Nb: 0.03 | Example |
| 5 | 0.0025 | 1.00 | 1.5 | 0.030 | 0.006 | 0.05 | 0.0015 | 0.035 | 0.10 | 0.05 | 0.0010 | V: 0.04, Mo: 0.10 | Example |
| 6 | 0.0025 | 1.6 | 1.5 | 0.030 | 0.006 | 0.05 | 0.0015 | 0.035 | 0.10 | 0.05 | 0.0010 | | Comparative Example |
| 7 | 0.0025 | 0.20 | 2.0 | 0.075 | 0.006 | 0.05 | 0.0015 | 0.035 | 0.01 | 0.01 | 0.0010 | | Comparative Example |
| 8 | 0.0025 | 0.20 | 2.0 | 0.075 | 0.006 | 0.05 | 0.0015 | 0.035 | 0.20 | 0.01 | 0.0010 | | Comparative Example |
| 9 | 0.0025 | 0.20 | 2.0 | 0.075 | 0.006 | 0.05 | 0.0015 | 0.035 | 0.02 | 0.25 | 0.0010 | | Comparative Example |
| 10 | 0.0025 | 0.20 | 2.0 | 0.060 | 0.006 | 0.05 | 0.0015 | 0.15 | 0.20 | 0.15 | 0.0010 | | Comparative Example |

TABLE 2

| No. | YS | TS | El | Appearance of coating | Appearance after forming | Remark |
|---|---|---|---|---|---|---|
| 1 | 310 | 450 | 37 | Good | Good | Example |
| 2 | 320 | 470 | 35 | Good | Good | Example |
| 3 | 318 | 466 | 36 | Good | Good | Example |
| 4 | 315 | 463 | 35 | Good | Good | Example |
| 5 | 340 | 490 | 34 | Good | Good | Example |
| 6 | 380 | 540 | 31 | Poor | Poor | Comparative Example |
| 7 | 290 | 433 | 38 | Poor | Poor | Comparative Example |
| 8 | 309 | 445 | 36 | Poor | Poor | Comparative Example |
| 9 | 311 | 446 | 36 | Poor | Poor | Comparative Example |
| 10 | 330 | 465 | 30 | Good | Poor | Comparative Example |

Steels 1 to 5, which are our steels, each exhibited a high strength of TS≥440 MPa and superior appearance. In Steel 6, whose Si content is outside our range, a coating defect occurred and the appearance of coating was not good. In addition, the appearance after forming was not good.

Steel 7, whose Cu and Ni contents are outside our range, exhibited inferior appearances of coating and after forming. Also, since steel 7 had not been solute-strengthened by addition of Cu and Ni, the strength was low. Steels 8 and 9, whose Ni and Cu contents are outside our range, exhibited inferior appearance, as in steel 7. It is therefore required that, to enhance the quality of appearance, Cu and Ni be added together. Steel 10, whose Ti content is outside our range, exhibited excellent appearance. However, liner defects occurred after forming, and the appearance after forming was inferior.

EXAMPLE 2

Galvanized steel sheets were produced under the conditions shown in Table 3 using Steel 1 shown in Table 1. Temper rolling was performed at an elongation ratio of 0.7%. The evaluations for tensile properties, appearances of coating and after forming were performed in the same manner as in Example 1. The results of the evaluations are shown in Table 4.

TABLE 3

| Steel sheet | Slab heating temperature (° C.) | Number of passes of roughing rolling | Number of times of descaling | FSB collision pressure (MPa) | FT (° C.) | CT (° C.) | Clod rolling degree (%) | Hydrogen concentration (volume %) | Annealing temperature (° C.) | Holding time (s) | Alloying |
|---|---|---|---|---|---|---|---|---|---|---|---|
| A | 1200 | 7 | 7 | 1.5 | 890 | 640 | 62.5 | 8.0 | 820 | 90 | Yes |
| B | 1200 | 5 | 3 | 1.0 | 890 | 600 | 62.5 | 11.5 | 850 | 30 | No |
| C | 1220 | 3 | 3 | 1.8 | 890 | 680 | 62.5 | 7.0 | 820 | 90 | No |
| D | 1200 | 9 | 9 | 3.0 | 890 | 620 | 75.0 | 10.5 | 810 | 120 | Yes |
| E | 1200 | 5 | 1 | 1.5 | 890 | 640 | 62.5 | 8.0 | 820 | 90 | Yes |
| F | 1200 | 7 | 5 | 0.8 | 890 | 400 | 62.5 | 8.0 | 820 | 15 | Yes |
| G | 1140 | 7 | 7 | 1.5 | 900 | 760 | 62.5 | 8.0 | 820 | 90 | Yes |
| H | 1260 | 3 | 3 | 1.5 | 970 | 640 | 62.5 | 6.0 | 820 | 90 | No |
| I | 1200 | 7 | 7 | 1.5 | 890 | 640 | 62.5 | 6.0 | 680 | 120 | Yes |
| J | 1200 | 7 | 7 | 0.5 | 890 | 640 | 62.5 | 8.0 | 900 | 60 | Yes |
| K | 1200 | 7 | 7 | 1.5 | 890 | 640 | 35.0 | 8.0 | 820 | 160 | Yes |

TABLE 4

| Steel sheet | YS (MPa) | TS (MPa) | El (%) | Appearance of coating | Appearance after forming | Remark |
|---|---|---|---|---|---|---|
| A | 310 | 450 | 37 | Good | Good | Example |
| B | 315 | 452 | 37 | Good | Good | Example |
| C | 306 | 442 | 38 | Good | Good | Example |
| D | 313 | 465 | 36 | Good | Good | Example |
| E | 308 | 449 | 36 | Poor | Poor | Comparative Example |
| F | 330 | 495 | 31 | Poor | Poor | Comparative Example |
| G | 290 | 420 | 36 | Poor | Poor | Comparative Example |
| H | 304 | 432 | 36 | Poor | Poor | Comparative Example |
| I | 410 | 503 | 30 | Poor | Poor | Comparative Example |
| J | 271 | 430 | 38 | Poor | Poor | Comparative Example |
| K | 298 | 432 | 36 | Good | Good | Comparative Example |

Steel sheets A, B, C and D produced under the conditions of our method each exhibited a strength as high as a TS of 440 MPa or more, and superior appearance. On the other hand, the steels sheet produced under conditions outside our range cannot satisfy both the tensile strength and the appearance. More specifically, Steel sheet E, which was produced under conditions of which the number of times of descaling was outside our range, was inferior in appearances of coating and after forming. Steel sheet E, which was produced under conditions of which the FBS collision pressure was outside our range, was inferior in appearances of coating and after forming. Also, the ductility was low because the coiling temperature was outside our range (as low as 400° C.) and the holding time for annealing was outside our range (as short as 15 s). Steel sheet G, which was produced under conditions of which the coiling temperature was outside our range (as high as 760° C.), exhibited a low tensile strength. Steel sheet H, which was produced at a high finishing temperature outside our range, exhibited a low tensile strength. Also, since the hydrogen concentration was low, the appearances of coating and after forming were inferior. Steel Sheet I, which was produced under conditions of which the hydrogen concentration was low, exhibited inferior appearances of coating and after forming. Also, since the annealing temperature was low, ductility was low while strength was high. Steel Sheet J, which was produced at an FSB collision pressure outside our range, was inferior in appearances of coating and after forming. Also, since the annealing temperature was high, the tensile strength was low. Steel Sheet k, which was produced at a low cold rolling reduction, exhibited a low tensile strength.

INDUSTRIAL APPLICABILITY

The high strength galvanized steel sheet does not have non-uniformity of coating or coating defects, and does not produce linear defects in the surface thereof even after press forming. Accordingly, it is suitable for automotive inner and outer panels. The method for manufacturing a high strength galvanized steel sheet can be applied to the manufacture of the high strength galvanized steel sheet.

The invention claimed is:

1. A high strength galvannealed steel sheet comprising:

a steel sheet having a recrystallized ferrite phase structure; and a galvannealed coating on the surface of the steel sheet, the steel sheet having a composition containing 0.0005% to 0.0040% by mass of C;

0.1% to 1.0% by mass of Si;

1.0% to 2.5% by mass of Mn;

0.01% to 0.20% by mass of P;

0.015% or less by mass of S;

0.01% to 0.10% by mass of Al;

0.0005% to 0.0040% by mass of N;

0.010% to 0.080% by mass of Ti;

0.0005% to 0.0020% by mass of B;

0.05% to 0.50% by mass of Cu;

0.03% to 0.50% by mass of Ni;

0.0030% to 0.0150% by mass of Sb; and the balance of Fe and incidental impurities, the composition satisfying Relationships (1) and (2):

$$[Ti] \geq (47.9/14) \times [N] + (47.9/12) \times [C] \quad (1); \text{ and}$$

$$[Ni] \geq 0.4 \times [Cu] \quad (2),$$

wherein [element] represents content (percent by mass) of the element, and wherein the high strength galvannealed steel sheet has a tensile strength (TS) of 440 MPa to 490 MPa and a yield strength (YS) of 306 to 340 MPa.

2. The high strength galvannealed steel sheet according to claim 1, wherein the composition further contains 0.0020% to 0.0150% by mass of Sn.

3. The high strength galvannealed steel sheet according to claim 2, wherein the composition further comprises at least one of 0.01% to 0.08% by mass of Nb, 0.01% to 0.08% by mass of V and 0.01% to 0.10% by mass of Mo, and if the composition contains Nb or V, Relationship (3) holds:

$$[Ti]+[Nb]+[V] \leq 0.08 \quad (3),$$

wherein [element] represents content (percent by mass) of the element.

4. The high strength galvannealed steel sheet according to claim 1, wherein the composition further comprises at least one of 0.01% to 0.08% by mass of Nb, 0.01% to 0.08% by mass of V and 0.01% to 0.10% by mass of Mo, and if the composition contains Nb or V, Relationship (3) holds:

$$[Ti]+[Nb]+[V] \leq 0.08 \quad (3),$$

wherein [element] represents content (percent by mass) of the element.

5. The high strength galvannealed steel sheet according to claim 1, wherein Cu and Ni are concentrated at the surface of the steel sheet.

6. The high strength galvannealed steel sheet according to claim 1, having an elongation (El) of 34-38%.

* * * * *